US006114931A

United States Patent [19]

Gevorgian et al.

[11] Patent Number: 6,114,931

[45] Date of Patent: Sep. 5, 2000

[54] SUPERCONDUCTING ARRANGEMENT WITH NON-ORTHOGONAL DEGENERATE RESONATOR MODES

[75] Inventors: Spartak Gevorgian, Göteborg; Erland Wikborg, Danderyd, both of Sweden

[73] Assignee: Telefonaktiebolaget LM Ericsson, Stockholm, Sweden

[21] Appl. No.: 09/099,273

[22] Filed: Jun. 18, 1998

Related U.S. Application Data

[63] Continuation of application No. PCT/SE96/01689, Dec. 18, 1996.

[30] Foreign Application Priority Data

Dec. 19, 1995 [SE] Sweden ..... 9504531

[51] Int. Cl.[7] ..... H01P 1/213

[52] U.S. Cl. ..... 333/995; 333/134; 333/219; 505/210; 505/701

[58] Field of Search ..... 333/995, 205, 333/219, 235, 134; 505/210, 700, 701, 866

[56] References Cited

U.S. PATENT DOCUMENTS

| | | | |
|---|---|---|---|
| 4,881,051 | 11/1989 | Tang et al. | 333/208 |
| 5,083,102 | 1/1992 | Zaki | 333/212 |
| 5,136,268 | 8/1992 | Fiedziuszko et al. | 333/219 X |
| 5,172,084 | 12/1992 | Fiedziuszko et al. | 333/204 |
| 5,721,195 | 2/1998 | Grothe et al. | 333/995 X |

FOREIGN PATENT DOCUMENTS

| | | | |
|---|---|---|---|
| 160801 | 7/1987 | Japan | 333/205 |
| 2 266 194 | 10/1993 | United Kingdom . | |

OTHER PUBLICATIONS

Curtis, J.A. et al; "Dual Mode Microstrip Filters"; *Applied Micro–Waves*; Fall 1991; pp. 86, 87, 90–93; copy available in CL 333/204.

Bahl, I.J. et al., "Microstrip Antennas", *Artech House*, 1980, pp. 130–132.

Shen, Zhi–Yuan, "High Temperature Superconducting Microwave Circuits", *Artech House*, May 3, 1995, pp. 214–218.

Haus, Hermann A., "Waves and Fields in Optoelectronics", *Prentice Hall*, 1984, pp. 210–213.

Vendik, O.G. et al., "1GHz tunable resonator on bulk single crystal $SrTiO_3$ plated with $YBa_2Cu_3O_{7-x}$ films", Electronic Letters, vol. 31 No. 8, Apr. 13, 1995, pp. 654–656.

Uher, Jaroslaw, et al. "Tunable Microwave and Millimeter–Wave Bank–Pass Filters", *IEEE*, Apr. 1991, pp. 643–653.

Pozar, David M., et al. "The Analysis and Design of Microstrip Antennas and Arrays", IEEE Press, 1995, p. 108.

*Primary Examiner*—Justin P. Bettendorf
*Attorney, Agent, or Firm*—Burns, Doane, Swecker & Mathis, L.L.P.

[57] ABSTRACT

Superconducting multiplexing/demultiplexing arrangements include a number of signal input devices and a number of signal output devices. A number of resonators provides a number of filters. Each filter represents a channel. The resonator(s) operate(s) devices at lest in dual mode, and tuning devices are provided so that at least some of the resonators is/are tuneable. A method is provided of multiplexing signals incoming to a multiplexing arrangement with a number of resonators, each of the resonators having a number of input ports which are so arranged that a number of mulitpole filters are created. Input signals having different frequencies are supplied to the different input ports of the resonators, each of which is operated in three modes. Coupling devices are arranged which at least comprise the angle between the input ports and a symmetry plane. The angles are non-perpendicularly azimuth. Tuning devices are further provided for tuning the resonant frequencies of the degenerate modes, and the coupling angles and tuning devices are controlled so that for a number of input signals, only input signal is transmitted to the output devices.

27 Claims, 7 Drawing Sheets

SUPERCONDUCTING ARRANGEMENT WITH NON-ORTHOGONAL DEGENERATE RESONATOR MODES

This application is a continuation of International Application No. PCT/SE96/01689, which was filed on Dec. 18, 1996, which designated the United States, and which is expressly incorporated here by reference.

BACKGROUND

The present invention relates to superconducting switching/multiplexing/demultiplexing arrangements with a number of channels comprising a number of resonators. The invention also relates to filters for microwave signals comprising a number of resonators.

Still further the invention relates to a method for multiplexing/demultiplexing signals.

Multichannel communication systems microwave frequency multiplexers are needed. J. Uher et al., discloses filter in "Tuneable microwave and millimeter-wave passband filters", IEEE Trans. Microwave Theory, 1991, Vol. 39, No. 4, p. 643. If for example the communication systems operate in the frequency band of 1–3 GHz however, the filters get very bulky and their performance characteristics are not satisfactory for a number of reasons, e.g. narrow band, low loss, high power handling capability etc. is needed which cannot be provided to a sufficient extent. In order to design compact filters, resonators have been constructed which operate in two modes, i.e. dual mode resonators. U.S. Pat. No. 5,083,102 discloses a filter with a dual mode dielectric resonator which employs two azimuthally perpendicular degenerate modes. The tuning and coupling between orthogonal modes and dielectric resonators is achieved mechanically by the use of screws. Parallel-plate resonators operating in dual mode are also known. I. Bahl and P. Bharita, "Microstrip Antennas", Artech house, 1980 discusses the use of a notch to provide coupling between two uncoupled orthogonal modes of patch resonators. U.S. Pat. No. 5,172,084 shows a filter wherein two degenerate modes of a microstrip patch resonator are used. Two pairs of conducting leads are used to provide two degenerate modes which are azimuthally perpendicular and a special perturber is used to facilitate the coupling between orthogonal modes. However, the filter performance strongly suffer from parasitic surface modes propagating in the common substrate carrying the patches, i.e there are parasitic couplings between the resonators.

In general, all of the filters discussed above are too bulky in particular for communication systems which operate in the 1–3 GHz frequency band and they do not have ideal performance characteristics such as a narrow band, low loss, high power handling capabilities etc. None of the described ways of coupling does provide sufficient flexibility to be used in multichannel multiplexers etc.

From U.S. Pat. No. 4,881,051 a multiplexer of a branching filter type is known. The design of the multiplexer is very complex and it is based on a plurality of cavities with half- and/or quarter-cut dielectric single mode resonators. The multiplexer has 2–4 channels. In the case of narrow band channeled it is extremely critical to manufacturing tolerances. Moreover, since it is limited to a maximum of four channels, presumably it would not work for multichannel systems with a higher number of channels, or in other words either it would not work for more than four channels or it would be even more complex and in no way cost-effective. Still further, the multiplexer does not seem to be tuneable which means that it can not be used in systems wherein tunability is required.

SUMMARY

What is needed is therefore a filter or particularly a multiplexing arrangement, which is small and compact. Moreover, what is needed is a filter which can be used in multiplexing (demultiplexing) arrangements or particularly a multi-pole channel filter with a straightforward and non-complex design and which can be used in communication systems which operate for example in approximately the 1 3 GHz frequency band without being bulky and which have good performance characteristics, i.e. narrow band, low loss, high power handling capability etc. Moreover a resonator is needed which operates in a multiple mode and which is suitable for filters and multiplexing arrangements for use for example in multichannel communication systems. Moreover a method for multiplexing signals in a multichannel communication system is needed which is efficient, has a high power handling capability and only gives rise to low losses.

What is needed is therefore also a superconducting multiplexing arrangement which comprises a number of signal input means and a number of signal output means and which further comprises a number of resonators which provide a number of filters which in turn each represent a channel wherein the resonators at lest operate in two modes and whrein at least some of the resonators are tuneable. Particularly, a current and/or an electric field redistribution needs to be produced, e.g. through introducing an asymmetry in the resonator, in order to create degenerate resonator mode.

Therefore, in order to provide for mutual coupling between degenerate modes in the resonators coupling means are provided which according to a particular embodiment form an angle for which the degenerate modes become coupled and which is achieved by arranging of input/output means either in relation to each other or in relation to a symmetry axis of the resonator in an appropriate way. The coupling angle is advantageously the azimuthal angle between the signal input and the resonator symmetry axis and the degenerate modes are non-orthogonal. According to a particular embodiment second coupling means can be provided which are used for controlling the strength of the coupling between the degenerate modes and/or for controlling the resonant frequencies of the coupled degenerate modes. The second coupling means may for example comprise notches arranged on the resonators and they are particularly useful to provide for controlling for a given coupling angle. Advantageously the lowest order of degenerate modes are coupled, particularly TM (transverse magnetic) modes. The resonant frequencies of at least some resonators can be tuned and the tuning is advantageously provided through applying and controlling a voltage through biasing means. Alternatively a number of the resonators may be optically tuneable and/or they can be temperature controlled/tuned. According to an advantageous embodiment the resonators are triple mode resonators which means that they operate in three different degenerate modes.

The multiplexing arrangement advantageously comprises a number of filters which are formed by a number of resonators and advantageously the number of resonators dies not exceed the number of filters which means that the number of resonators for a number of multi-pole channel filters is considerably reduced as compared to hitherto known frequency combining arrangements.

A particular embodiment relates to a two-channel multiplexer which comprises a resonator with two input ports and an output port forming two channels each of which comprises a two-pole filter. Coupling is provided by the first and second azimuthal coupling angles between the resonator symmetry axis and the first and the second signal input port respectively. A first tuning or biasing for example consist in that no biasing is applied (or anything else), so that only one of the first and second input signals is output via the signal output means of the signal output port whereas for a different biasing or tuning condition only the other of the input signals is output via the signal output means. The biasing or tuning may be provided by the application of a biasing voltage. Alternately or additionally temperature or optical tuning can be used.

According to another embodiment the arrangement comprises a four-channel multiplexer with four inputs and a common output and which comprises three tuneable resonators. It is a branching filter multiplexer wherein each branch comprises a four-pole filter. The first and second coupling means and the biasing conditions are so chosen that only one of four input signals is output via the common output means. According to still another embodiment the arrangement comprises an eight-channel multiplexer which is formed by seven resonators with six-pole tuneable filters in each branching channel. Still further it may be a multichannel multiplexer having more than eight channels.

According to an advantageous embodiment the resonators (relevant to all embodiments) are parallel-plate resonators. The resonators may e.g. be disk, ring, rectangular resonators or they may even have any arbitrary shape. Still further, the resonators may be made from a non-linear bulk material having a high dielectric constant and which is at least partly covered by high temperature superconducting HTS films. This is extremely advantageous for forming small and compact resonators.

Particularly a resonator is provided which operates in three modes for which the coupling is given by the azimuthal angle between the degenerate modes and wherein the degenerate modes are not azimuthally perpendicular. The angle between them and the coupling between them is produced by the arranging of input/output ports in a corresponding way and the resonator is additionally controlled or tuned for example electrically. Alternatively it may be optically or temperature controlled. Mechanical tuning can also be applied, e.g. using piezoelectric means. As an alternative additional coupling means may be provided for example in the form of (a) notch(es) or similar.

A multi-pole filter is also provided which comprises a number of multimode resonators with three azimuthally degenerate modes.

It is an advantage of the invention that a particular small compact arrangement is provided and which can be used for communication systems, for example telecommunications systems operating in the 1 3 GHz frequency band. A particular advantage of the invention is that, particularly if the triple mode regime is used, the reduction of the numbers of resonators per channel or per filter can be considerably reduced. The multiplexer size is thereby also further reduced. It is also an advantage that additional functional flexibility for microwave systems wherein tuneable frequency channels are needed, for example adaptive and/or reconfigurable microwave system etc. is provided. Another advantage of the invention is that the manufacturing tolerances are not critical for the filter or multiplexer which as such make the arrangement more robust and less sensitive to faults etc.

BRIEF DESCRIPTION OF THE DRAWINGS

The invention will in the following be further described in a non-limiting way under reference to the accompanying drawings in which.

DETAILED DESCRIPTION

Figure 1A:
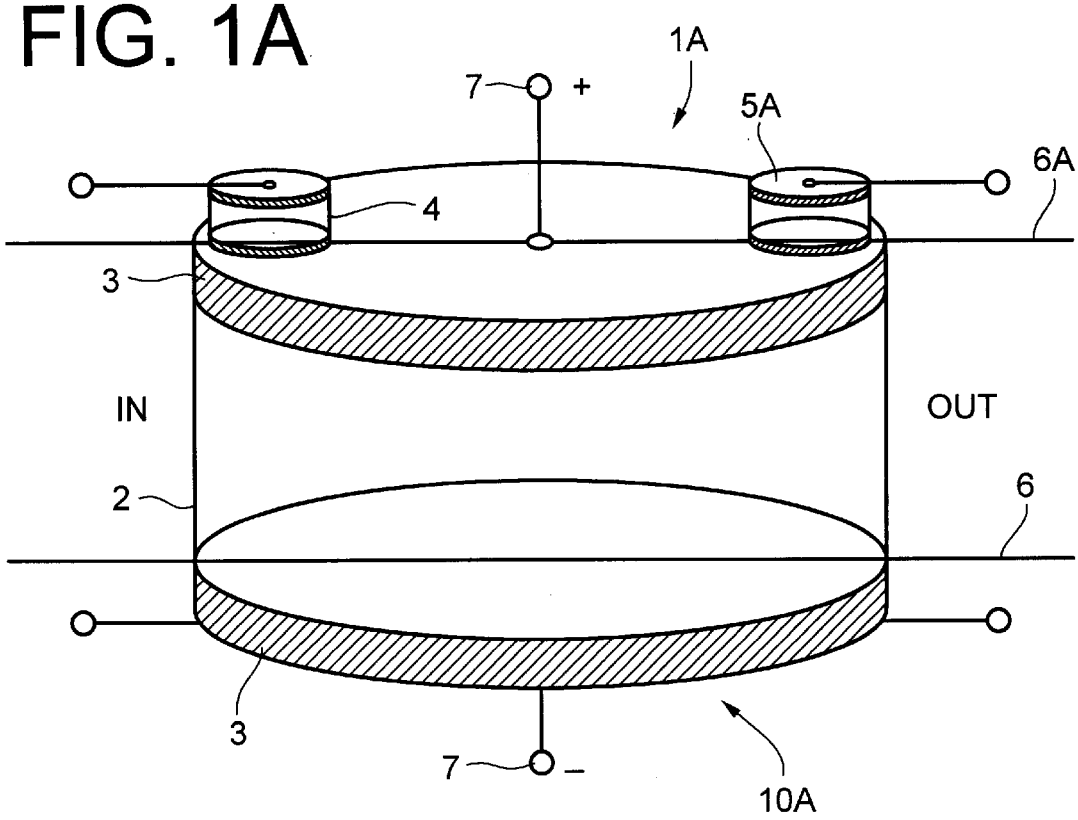
FIG. 1A illustrates a parallel-plate circular disk resonator with symmetric excitations.
Figure 1B:
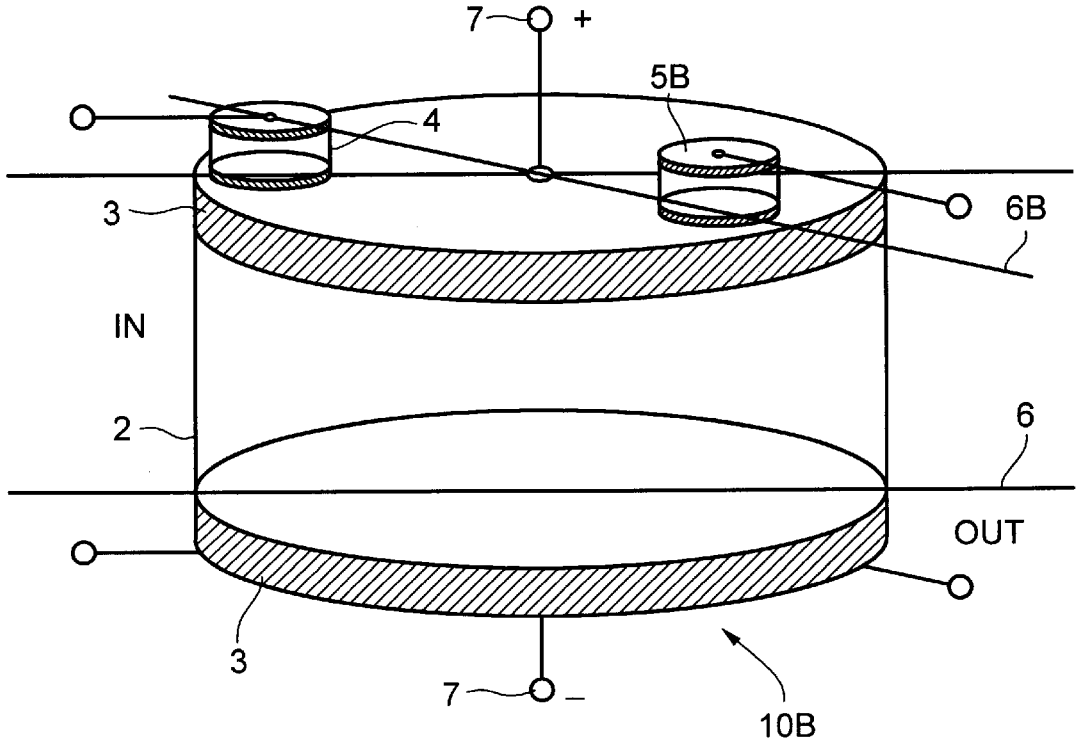
FIG. 1B illustrates a parallel-plate circular disk resonator with asymmetric excitations, FIGS. 2A, 2B, 2C and 2D respectively illustrate the field and current distribution of the first four lowest order modes in a parallel-plate circular disk resonator.
Figure 2A:
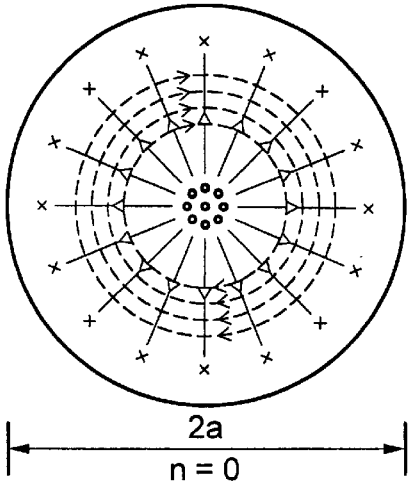
Figure 2B:
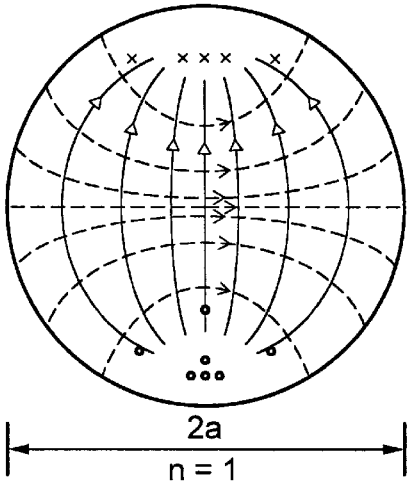
Figure 2C:
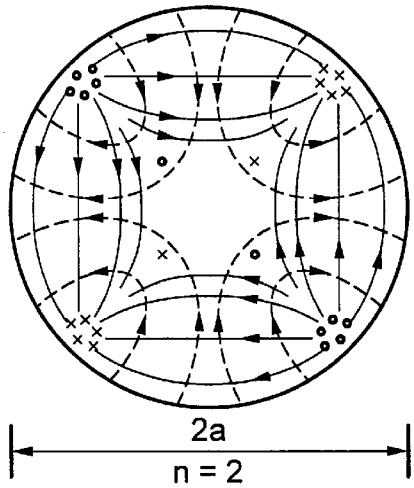
Figure 2D:
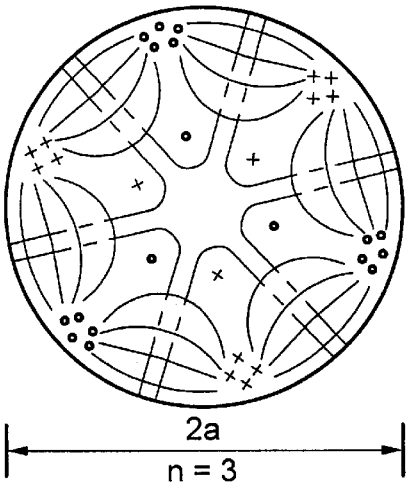

FIG. 1A illustrates, for explanatory reasons, a parallel-plate circular disk resonator with symmetric excitations. The circular parallel-plate disk resonator 10A comprises a single-crystal non-linear dielectric material 2 which is partly covered for example by high temperature superconducting (YBCO) or Au plates 3 which may be deposited by some known method (this is among others discussed in Z-Y Shen, "High Temperature Superconducting Microwave Circuits", Artech house 994). This will be further discussed below. The superconductors are arranged on both the flat surfaces of the dielectric materials 2. Connection means 7 is provided through which a DC biasing voltage may be applied. Connection means 7 is provided with a positive terminal (+) and a negative terminal (−). Resonator 10A has an input end (In) and an output end (Out). The input and output coupling 4, 5A are symmetrically arranged in relation to a symmetry plane or a symmetry axis 6,6A of the resonator. FIG. 1B illustrates another embodiment of a circular parallel-plate circular disk resonator 10B. The parts of FIG. 1B corresponding to those of FIG. 1A are identified by the same reference numerals. In FIG. 1B, however, the input and output coupling ports 4,5B are so arranged that an asymmetry is introduced in the otherwise perfectly symmetric resonator. The resonator of FIG. 1B, which in all other aspects corresponds to the resonator of FIG. 1A is provided with an asymmetry in that the output port and the input port are so arranged that they are azimuth in relation to a symmetry plane 6B. The reference numbers of FIG. 1B that correspond to FIG. 1A represent like elements that perform like functions and, thus will not be described further.

Figure 3A:
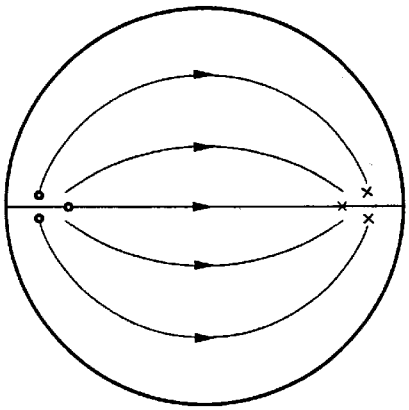
FIG. 3A illustrates the current distribution of a single lowest order mode in a circular parallel-plate resonator.
Figure 3B:
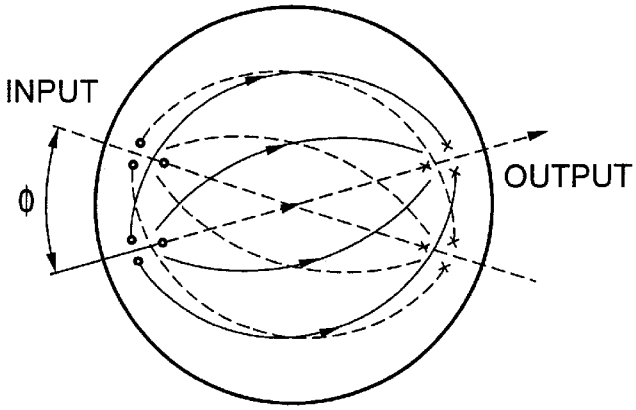
FIG. 3B illustrates the current distributions of two degenerate lowest order modes in a resonator as above.

The distributions of currents and of the magnetic and electrical fields for the four lower order TM modes of a circular (perfectly axially symmetric) disk resonator for which the thickness of the dielectric material is less than the microwave signal wavelength in the dielectric material, are shown in FIGS. 2A, 2B, 2C and 2D, respectively. The resonant form frequencies of perfectly symmetric resonators are given by $$f_{mn} = \frac{K_{mn} c_o}{2\pi f \sqrt{\varepsilon}}$$

as discussed in "Microstrip Antennas", Artech House 1980 by I. Bahl, P. Bharita. $c_0$ is the velocity of light in vacuum, a is the radius of the disk, $\epsilon$ is the dielectric constant and $K_{mn}$ is the m-th zero of the derivative of the Bessel function of order n. In FIGS. 2A, 2B, 2C, and 2D respectively a continuous line with an arrow indicates the current in the top late whereas a dashed-dotted line indicate the magnetic field and ●, x indicate the electric field in a generally recognized manner. For the lowest order $TM_{11}$ mode, $K_{mn}$=1.8412. The current distribution for this mode is shown in FIG. 3A wherein continuous lines indicate the current and ., x indicate the direction of the electrical field. If an asymmetry is introduced in the disk, this produces a field/current redistribution, the result of which being that degenerate modes are created. As already referred to above an asymmetry may be introduced by arranging the input and output coupling ports in the proper places, for example as schematically indicated in FIG. 1B. Of course an asymmetry may also be introduced in other ways. In FIG. 3B a current distribution is shown for a resonator in which the input and output excitation points are shifted by an angle Φ. In FIG. 3B a continuous line indicates current lines for the basic (excited) $TM_{11}$ mode whereas a dashed line indicates current lines for the degenerate (output) $TM_{11}$ mode.

However, the mutual coupling between two degenerate modes vanishes for an angle of approximately 90°. For this angle the degenerate modes of the perfectly symmetric resonator are not coupled and the resonant frequencies of the two modes are in practice the same. However, for other angles and/or any asymmetry in the resonator, coupling is produced between the degenerate modes. In "Fundamentals for Microwave Engineering" by R. E. Collin, McGraw-hill, 1966 the coupled wave theory is discussed and the coupled degenerate modes result in two new modes having slightly different frequencies. If the angle is correctly chosen, the degenerate modes can be mutually coupled and the resonator is forced to operate as a two pole filter with either maximally flat or with Chebyshev passbands. For a fixed angle the coupling strength between the modes, therethrough also the resonant frequencies, can be controlled through the introduction of additional coupling means. These additional coupling means, in the following denoted second coupling means, may for example comprise a notch in a plate of a parallel plate resonator or anything similar. Of course a number of other alternatives are also possible.

In FIGS. 6, 6A, 6B, 6C, 6D, 7, 7A, 7B, 7C, 7D, 8 and 9 a number of different embodiments of the present invention will be shown. However, before going into detail as far as these particular embodiments are concerned, examples will be given on how the resonators can be made. The following discussion is also relevant to the particular embodiments as discussed under reference to FIGS. 6, 6A, 6B, 6C, 6D, 7, 7A, 7B, 7C, 7D, 8 and 9 as well as to further embodiments which are not discussed here but which also fall within the scope of the invention. The invention is however not limited to resonators made a described below, but the following examples only relate to embodiments through which it is possible to further reduce the size of the resonators and thus also of the filters and multiplexers and to even further improve the tunability.

High temperature superconductors, in the following denoted HTS, have extremely low microwave losses at temperatures of liquid nitrogen, in the following denoted $N_{liq}$, at 77 K. In an advantageous embodiment HTS is used for narrow-band filters with low losses for multichannel communication systems. HTS microwave circuits are discussed in Z-Y Shen in "High temperature Superconducting Microwave Circuits", Artech house 1994. Small size electrically and/or temperature controlled resonators having very high Q-values in the 1–3 GHz frequency band can be realized through the integration of HTS with non-linear dielectric materials. This is among others discussed in "1 GHz tunable resonator on bulk single crystal. $SrTiO_3$ plated with YBCO", by O. G. Vendik et al., in Electronics. Letters, 1995, Vol. 31, No 8, p. 654. Therein a resonator is discussed which however is mounted in a coaxial fixture, because it is not suited for dual mode operation and use in multichannel multiplexers. Moreover, the dimensions are not as small as needed for such applications which among others is due to the fact that not the lowest resonant mode is used which according to the present invention is advantageous and contributes in reducing the dimensions.

Figure 4:
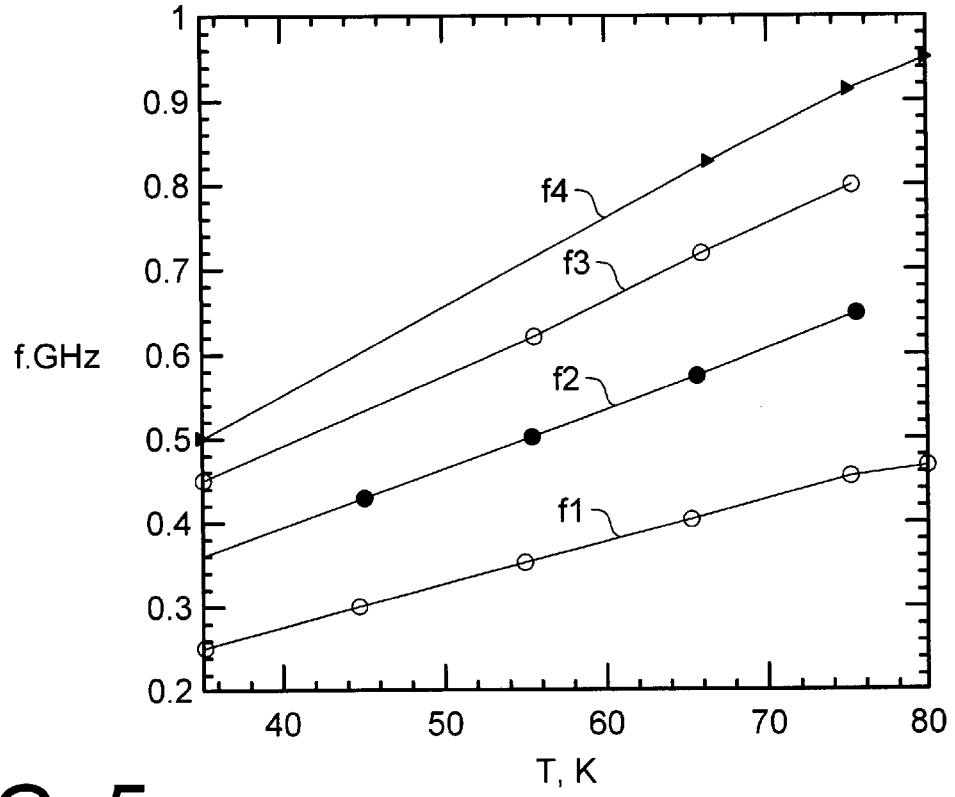
FIG. 4 illustrates the temperature dependence of the resonant frequencies of the four lowest order modes of a superconducting parallel-plate resonator.

However, non-linear dielectric single crystalline materials such as for example strontium titanate STO have extremely high dielectric constants and moreover the microwave losses are very low in the temperature range below the boiling temperature of $N_{liq}$. Thus, as referred to above, a non-linear dielectric material such as e.g. STO can be used to sill further reduce the size of the resonators but also to tune the resonant frequency of the resonator. Tuning may either be effected through the control of an applied voltage or controlling of the temperature. Alternatively optical tuning can be applied. In FIG. 4 is illustrated how the resonant frequencies shown as $f_1$, $f_2$, $f_3$ and $f_4$ of the four lowest order modes of a superconducting parallel plate resonator depend on temperature. It follows from the almost linear dependence of the resonant frequencies of all modes below 80 K that the reduction of the dielectric constant of STO has a $T^{-2}$ dependence in this temperature range.

Figure 5:
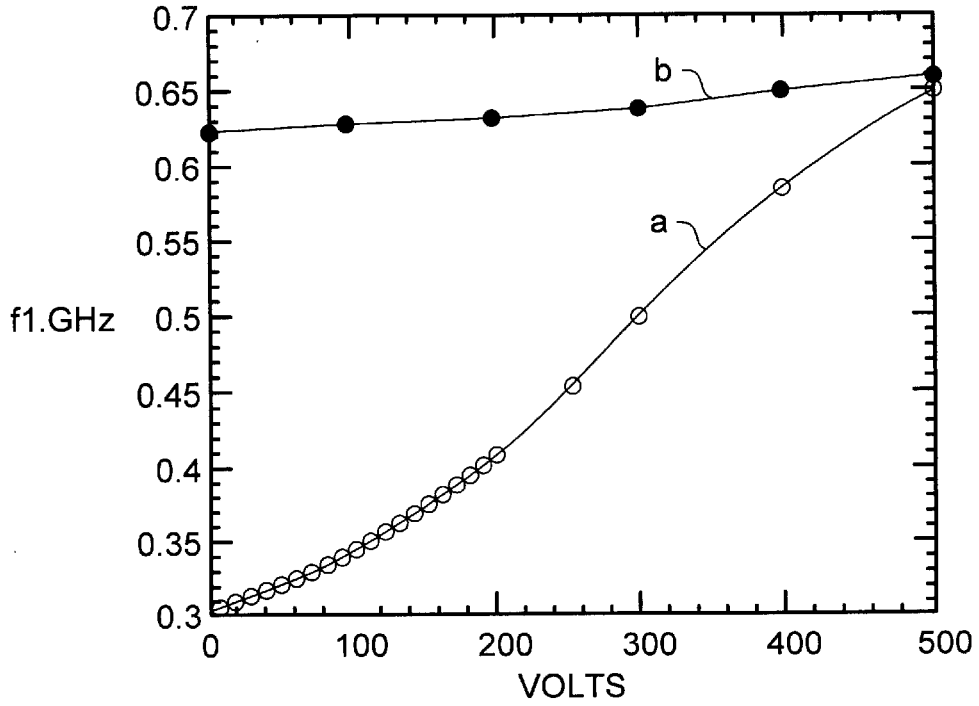
FIG. 5 illustrates the voltage dependence of the resonant frequencies.

The four lowest TM modes, $TM_{01}$, $TM_{11}$, $TM_{21}$ and $TM_{31}$ have K values $K_{01}$=3.8317, $K_{11}$=1.8412, $K_{21}$=3.0542 and $K_{31}$=4,2012 and within these four lowest modes, the lowest frequency belongs to the $TM_{11}$ mode. For example for a resonator having a diameter 5 mm, the resonant frequency of this mode is close to 0.95 GHz at 77 K when no biasing voltage is applied. In FIG. 5 is illustrated how the resonant frequency of the $TM_{11}$ mode depends on the applied voltage for two different temperatures, 35 K and 75 K. "a" illustrates the dependence of the $TM_{11}$ mode on the applied voltage at 35 K whereas "b" illustrates the corresponding dependence at 75 K.

The small differences in resonant frequencies of the degenerate mode referred to above and the temperature and the voltage dependencies of these frequencies can be used to control passband filters and multiplexers by varying the bias voltage or the temperature etc.

One example of a double mode performance STO parallel plate disc resonator with superconducting plates for example of YBCO can according to one particular example, which merely is given for illustrative purposes, have a resonator diameter of about 10 mm and a dielectric thickness of about 0.5 mm. The coupling angle may be about 10° and the first and second biasing voltages can for example be 0 V and 200 V respectively. This is however merely to be interpreted as one example among many others.

Figure 6:
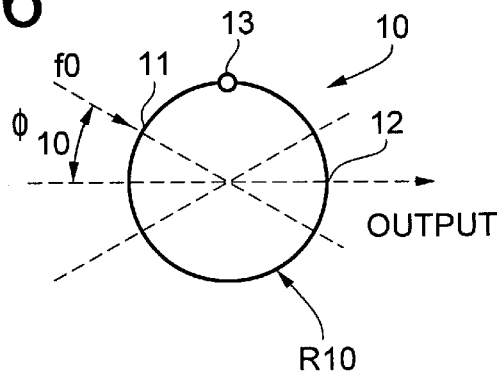
FIG. 6 shows a tuneable two-pole filter.
Figure 6A:
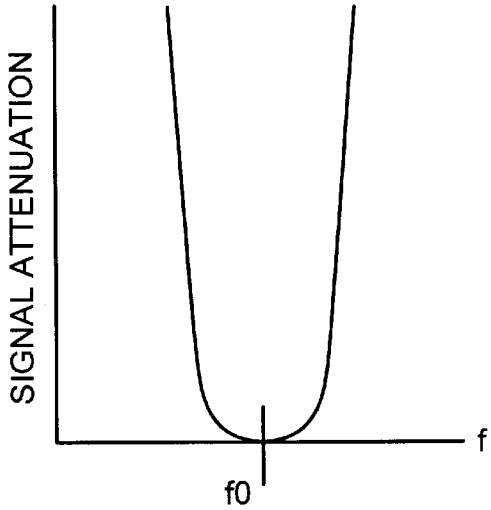
FIG. 6A illustrates the passband of the filter of FIG. 6 for a first biasing condition.
Figure 6B:
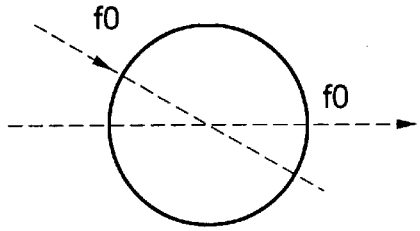
FIG. 6B illustrates in- and output signal frequency for the biasing condition of FIG. 6A.
Figure 6C:
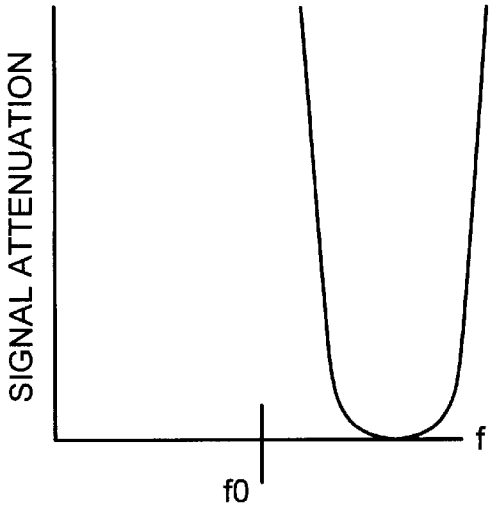
FIG. 6C shows the passband of the filter for a second biasing condition.
Figure 6D:
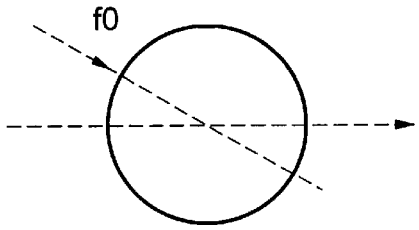
FIG. 6D is a Figure similar to FIG. 6B for the biasing condition of FIG. 6C.

FIG. 6 illustrates a tuneable multiplexer-filter/switch 10. A microwave signal with the frequency $f_0$ is supplied to the input port 11 of a two-pole filter comprising a dual mode tunable resonator R 10. Signal output means in the form of a signal output port 12 are provided through which a signal is output. The angle $\Phi_{10}$ comprises the first coupling means whereas a notch or a similar constitute the second coupling means 13. FIG. 6A and FIG. 6B illustrate the passband of the filter 10 for first biasing conditions e.g. corresponding to a voltage $V_0$ and/or a temperature $T_0$. For these first biasing condition, e.g. corresponding to zero voltage, the central frequency of the filter coincides with the frequency of the input signal. The input signal having the frequency $f_0$ is then transmitted through the filter with the lowest possible attenuation. The resonator is shown in FIG. 6B, i.e. it can be seen from the figure that the input signal with frequency $f_0$ is also output from the filter. FIGS. 6A, 6B and 6C also show the input signal with frequency $f_0$.

FIG. 6C shows the passband of the filter for a second biasing condition corresponding for example to be applied voltage $V_1$ and/or a temperature $T_1$. The passband is then shifted so that the signal frequency of the input signal falls in the rejection band and it is strongly attenuated at the output port 12. As can be seen from FIG. 6D, in this case no signal is output. The performance of the filter, which here is a passband filter, is given, or can be controlled by the angle $\Phi_{10}$ that the signal input port 11 for the input signal forms with a symmetry plane of the resonator wherein the angle forms the first coupling means as shown in FIG. 6. Advantageously it can be additionally controlled by second coupling means 13. The tuneable filter/switch as illustrated in FIGS. 6, 6A, 6B, 6C and 6D can be said to form a basic unit of more complexes tuneable filters or multiplexing arrangements as will be discussed below.

Figure 7:
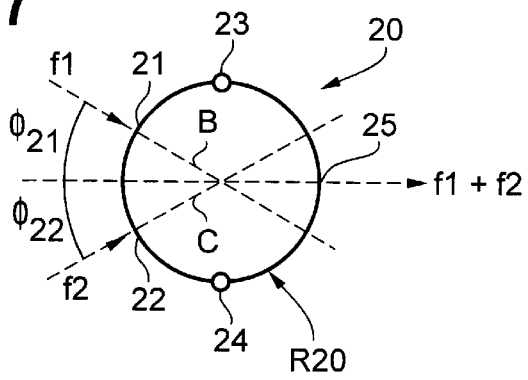
FIG. 7 illustrates a tuneable two-channel multiplexer.
Figure 7A:
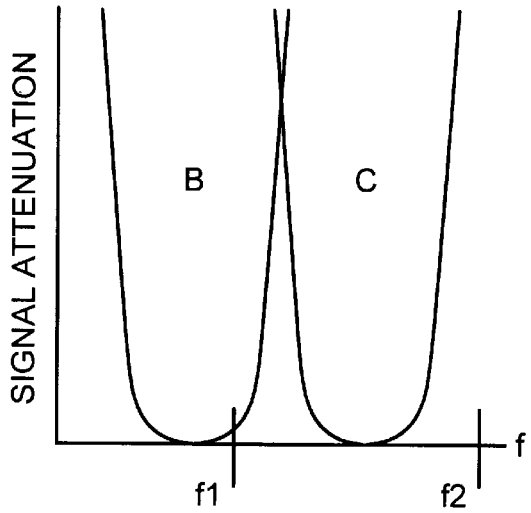
FIG. 7A illustrates the passband for the multiplexer of FIG. 7 for a first biasing condition.
Figure 7B:
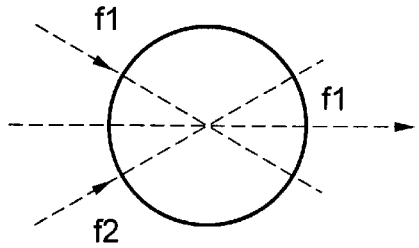
FIG. 7B illustrates the input signals and the output signal for the biasing condition of FIG. 7A.
Figure 7C:
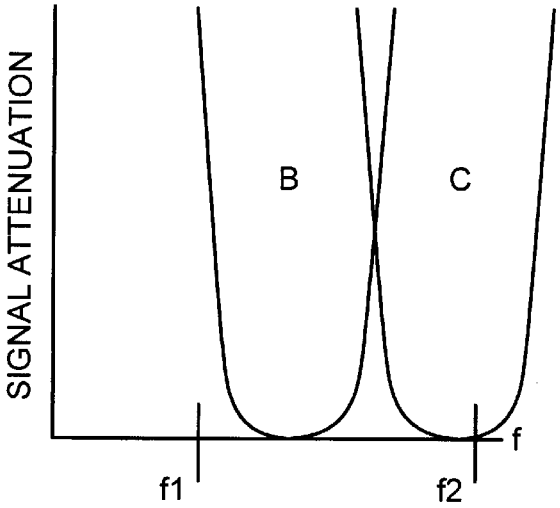
FIG. 7C illustrates the passband for the arrangement of FIG. 7 for a second biasing condition.
Figure 7D:
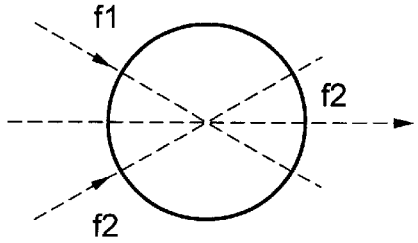
FIG. 7D shows the input and output signals for the second biasing condition of FIG. 7C.

In FIG. 7 a second embodiment is illustrated which comprises a tuneable two-channel multiplexer 20. A first and a second microwave signal $f_1$, $f_2$ are supplied to a first input port 21 and to a second input port 22 respectively of a single parallel-plate circular disk resonator R 20. The frequencies $f_1$; $f_2$ differ slightly. The output port 25 forms a two-pole filter with the first input port 21 in a manner similar to that as described under reference to FIG. 6. Either of the frequencies $f_1$, $f_2$, can be transmitted to the output port 25, shown as $f_1$, $f_2$. This filter will in the following be denoted filter B. The performance of filter B is determined by the first coupling means, i.e. the angle $\Phi_{21}$ and the second coupling means 23, 24. A second two-pole filter is in a similar manner formed between the second input port 22 and the output port 25 which is a common output port both for the first and for the second input ports. This filter will in the following be denoted filter C. Its performance is correspondingly given by angle $\Phi_{22}$ and the second coupling means 23, 24. In FIG. 7A the passbands for filters B and C respectively are illustrated for a first biasing condition for example corresponding to a voltage an/or temperature biasing condition. The first coupling means, i.e. the coupling angles $\Phi_{21}$, $\Phi_{22}$ and the second coupling means 23, 24 are so chosen that the frequency of the first input signal $f_1$ is in the passband of filter B whereas the frequency of the second input signal $f_2$ is in the rejection band of filter C. Consequently only the input signal with the first input frequency $f_1$ is output from the common signal output means 25. This can also be seen from FIG. 7B. In a similar manner FIGS. 7C and 7D illustrate the passbands for a second biasing condition corresponding to voltage and/or temperature biasing conditions wherein only the second input signal $f_2$ appears at the output port 25. The coupling is primarily given by the azimuthal angle between degenerate modes which is given by the arranging of the input/output ports. In the embodiment illustrated here, there is a two-pole filter in each channel. The parts of FIGS. 7*b,* 7C and 7D corresponding to those of FIG. 7 identified by the same reference numerals.

Figure 8:
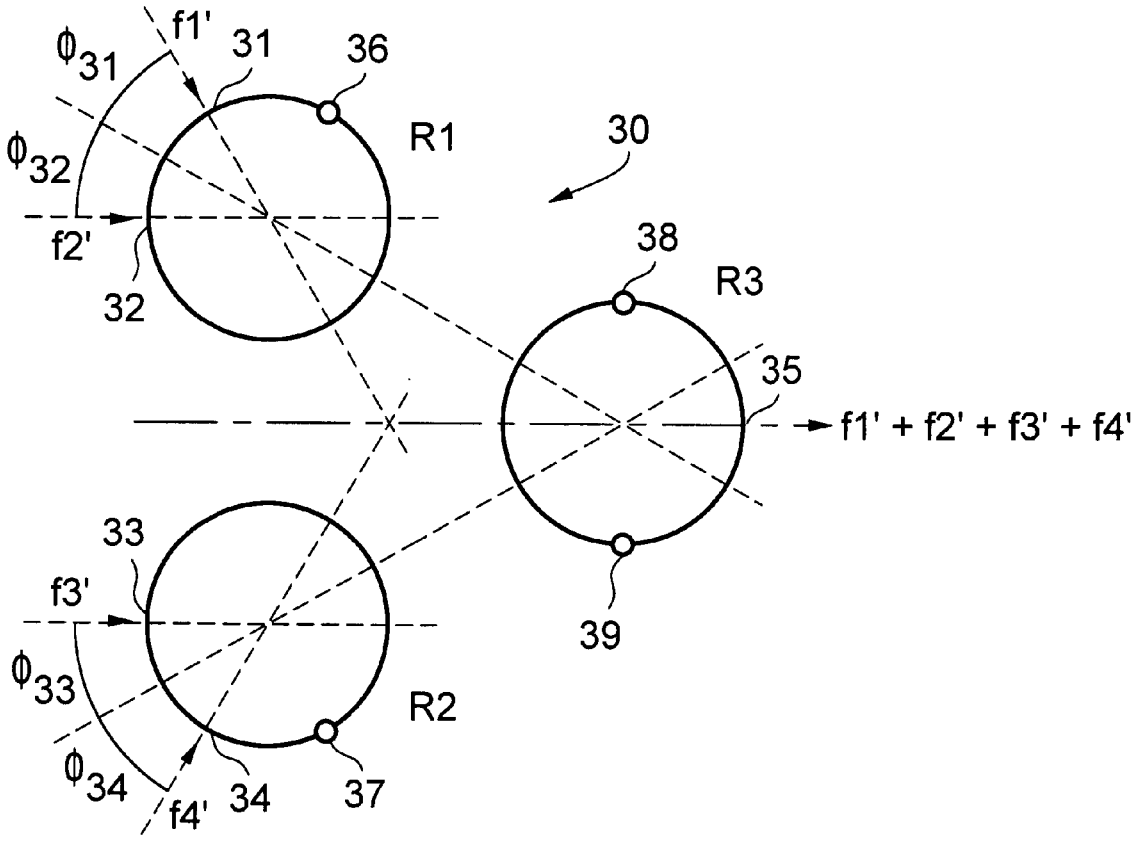
FIG. 8 shows a four-channel multiplexer.

FIG. 8 illustrates another embodiment of the invention which relates to a four-channel multiplexer 30. According to the present invention, only three resonators R1, R2, R3 are required for a four-channel branching filter multiplexer. In the present embodiment all of the three resonators are tuneable. The multiplexer 30 comprises four input means in the form of four input port 31, 32, 33, 34 of which two 31, 32 are comprised by a first resonator R1 and input ports 33, 34 are comprised by the second resonator R2. Once common output port 35 is comprised by the third resonator R3. There is thus one common output port for all the input ports. The first resonator R1 forms a two-channel multiplexer with the third resonator R3 wherein said multiplexer comprises two four-pole tuneable branching filters. The second and the third resonators R2, R3 in a similar manner from another two-channel four-pole filter. The first and the second coupling means, i.e. here the coupling angles $\Phi_{31}$, $\Phi_{32}$, $\Phi_{33}$, $\Phi_{34}$ and the second coupling means 36, 37, 38, 39 and the respective coupling strength between the resonators as well as the biasing conditions are so chosen that only one of the input signals with higher of the frequencies $f_1$, $f_2$, $f_3$, $f_4$ can be transmitted to the output port 35 $f_1'+f_2'+f_3'+f_4'$. It can thus be seen that only three resonators are needed to provide a four-pole branching filter multiplexer, which is advantageous.

Figure 9:
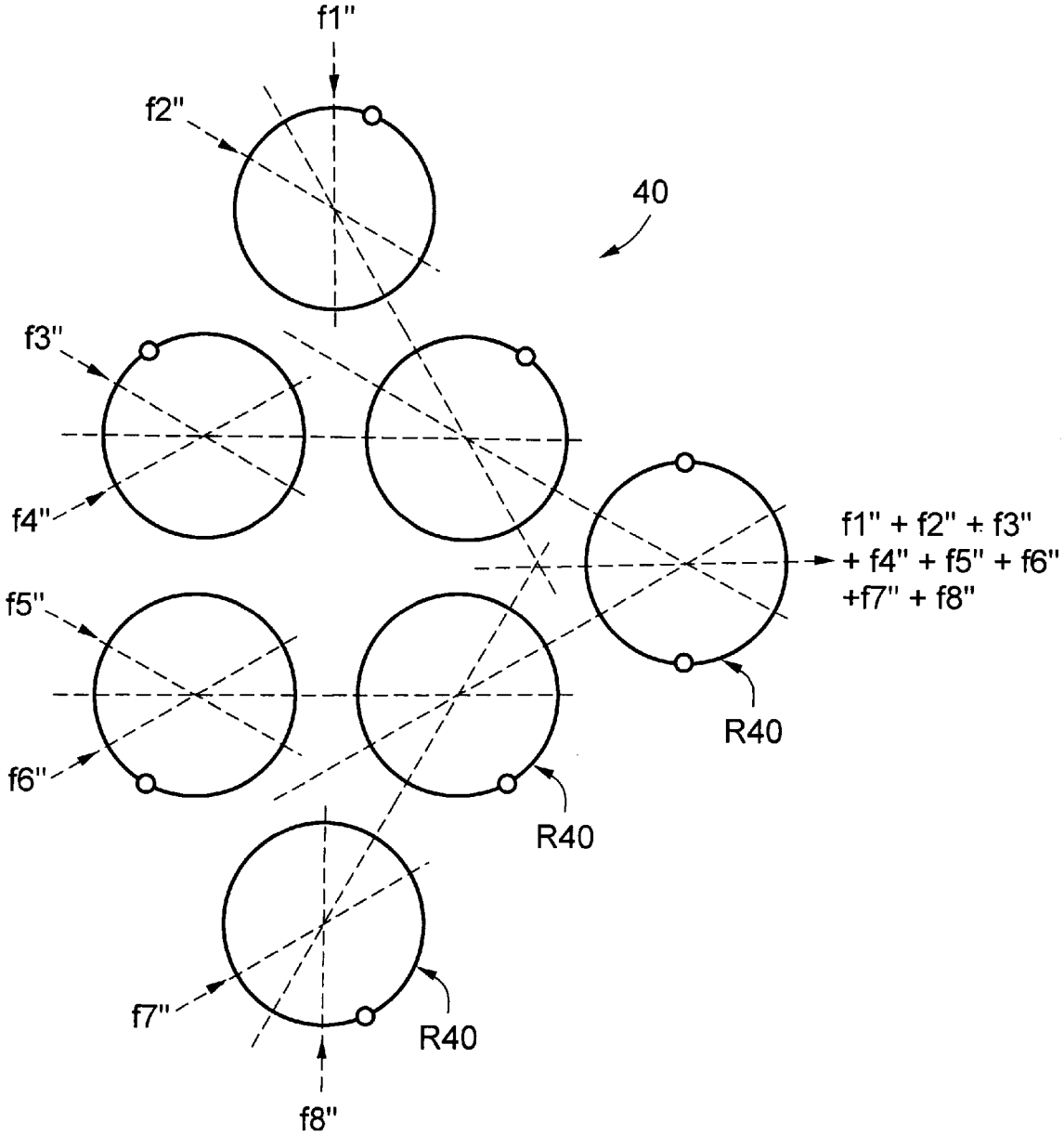
FIG. 9 shows an eight-channel multiplexer.

In FIG. 9 an eight-channel multiplexer 40 is illustrated. The multiplexer 40 comprises eight input ports for signals with the frequencies. $f_1''$, $f_2''$, $f_3''$, $f_4''$, $f_5''$, $f_6''$, $f_7''$ and $f_8''$ and there is one common output to which on of the input signals can be transmitted shown as $f_1''+f_2''+f_3''+f_4''+f_5''+f_6''+f_7''+f_8''$. As already discussed above this is given by the first and second coupling means, i.e. the coupling angles between respective axis of the resonators and signal input ports so that three degenerate azimuthal non-perpendicular mode s are created. This is not further discussed here since the same principles apply as discussed in relation to the other embodiments. However, it can be seen that for an eight-channel multiplexer only seven resonators R40 are needed. The resonators forms six-pole tuneable filters in each branching channel. As a comparison, to make an eight-channel multiplexer as a traditional combiner with on-pole dielectric resonators, 48 resonators would have been required.

According to the present invention also higher order multiplexers can be provided using the same principles, which however not need to be illustrated in any figure since it should be clear from the foregoing how such should be made.

Even if the invention has been more carefully described under reference to multiplexing arrangements, it is obvious that it also applied to demultiplexing arrangements. The invention applies to resonators having substantially any form such as disk, ring, rectangular or any arbitrary shape or particularly any kind of parallel-plate resonators but it is also possible to use so called image resonators. Earlier in the description resonators comprising bulk crystal like dielectric materials such as STO plated with e.g. YBCO or any other HTS-material. This relates to advantageous embodiments through which for example the size can be even more reduce. It should be clear that this merely relate to particular embodiments. The resonators can also be made in other ways and the superconducting material does not have to be high temperature superconducting material etc. The invention is also in the other aspects not limited to the shown embodiments but it can be varied in a number of ways and particularly it relates to demultiplexers as well as to multiplexers.

What is claimed is:

1. Superconducting switching arrangement comprising a number of signal input means, a number of signal output means, a number of resonators providing a number of filters, each filter representing a channel, the resonators at least operating in dual mode, and tuning means, wherein asymmetries are produced in the resonators to provide an electric field redistribution so that degenerate resonator modes are created, and the tuning means tune at least some of the resonators, further comprising first coupling means to provide mutual coupling between degenerate modes in the resonators, wherein an input means and an output means are arranged such that at lest one angle is formed for which the degenerate modes become coupled, said angle forming first coupling means, and wherein the coupling angle is an azimuthal angle between the signal input and a resonator symmetry axis, and the degenerate modes are non-orthogonal in relation to each other.

2. Arrangement according to claim 1, further comprising second coupling means for controlling the strength of the coupling between the degenerate modes or for controlling resonant frequencies of the coupled degenerate modes for a given coupling angle, wherein the resonant frequencies are determined by dielectric substrate and plates.

3. Arrangement according to claim 2, wherein the second coupling means comprise a number of notches arranged on the resonators.

4. Arrangement according to claim 1, wherein lowest order of degenerate (TM) modes are coupled.

5. Arrangement according to claim 1, wherein some of the resonators are electrically tunable.

6. Arrangement according to claim 1, wherein a number of the resonators are optically or mechanically tunable or temperature tuning is applied.

7. Arrangement according to claim 1, wherein a number of the resonators are triple mode resonators.

8. Arrangement according to claim 7, wherein some of the resonators comprise three azimuthal degenerate modes.

9. Arrangement according to claim 1, wherein the number of resonators needed to provide a given number of filters does not exceed the number of filters.

10. Arrangement according to claim 1, wherein the arrangement comprises a switch which comprises one resonator, wherein an input port forms an azimuth coupling angle with a symmetry axis for which coupling is provided between degenerate modes so that, depending on biasing conditions, an input signal is transmitted to an output port or prevented from being transmitted to the output port.

11. Arrangement according to claim 1, said arrangement forming a two-channel multiplexer comprising a resonator, wherein each channel comprises a two-pole filter, and coupling is given by a first and second azimuthal coupling angles between a resonator symmetry axis and first and second signal input means, respectively, said first and second signal input means having a common signal output means.

12. Arrangement according to claim 11, wherein for a first tuning or biasing condition, only the first input signal is output via the signal output means, whereas for a second biasing condition, only the second input signal is transmitted to the signal output means.

13. Arrangement according to claim 1, said arrangement forming a four-channel multiplexer with four input ports, a common output port and three tunable resonators.

14. Arrangement according to claim 13, wherein said arrangement is a branching filter multiplexer, and each branching filter multiplexer comprises a four-pole filter.

15. Arrangement according to claim 13, wherein a first resonator and a second resonator comprise two four-pole tunable branching filters, and a third resonator forms two further four-pole tunable filters with the first resonator.

16. Arrangement according to claim 13, wherein first and second coupling means and biasing conditions are such that only one of four input signals is output at a time.

17. Arrangement according to claim 1, said arrangement forming an eight-channel multiplexer comprising seven resonators, each with six-pole tunable filters in each branch channel.

18. Arrangement according to claim 1, said arrangement forming a multichannel multiplexer having more than eight channels.

19. Arrangement according to claim 1, wherein the resonators are made from a non-linear bulk material with a high dielectric constant at least partly covered by high temperature superconducting (HTS) films.

20. Arrangement according claim 1, wherein the resonators are parallel plate resonators.

21. Arrangement according to claim 1, wherein the resonators are disk, ring, or rectangular resonators or resonators of an arbitrary shape.

22. Arrangement according to claim 1, wherein the filters are bandpass filters.

23. Tuneable filter for electromagnetic signals comprising a number of input ports, a number of output ports, a number of resonators, and tuning means, wherein asymmetries are produced in the resonator(s) to provide a current or an electric field redistribution so that degenerate resonator modes are created, each resonator being a multimode resonator, and the tuning means tune resonant frequencies of the degenerate modes, wherein each resonator comprises at least tow azimuthally degenerate modes which are not perpendicular to each other, and coupling between the degenerate modes is given by an azimuthal angle between the respective input port and a resonator symmetry plane, and the degenerate modes are non-orthogonal in relation to each other.

24. Tuneable filter according to claim 23, wherein three azimuthal degenerate modes are used.

25. Tuneable filter according to claim 23, wherein the tuning means comprise electrical connections for the application of a biasing voltage.

26. Method for multiplexing electromagnetic signals incoming to a multiplexing arrangement comprising a number of resonators, each with a number of input ports so arranged that a number of mulitpole filters are created, the method comprising the steps of:

supplying a number of input signals having different frequencies to the different input ports of resonators, each of which comprises at least two input ports, operating each resonator in three modes, arranging coupling means for the resonator, wherein said coupling means comprises the introduction of asymmetries to provide a current or an electric field redistribution so that degenerate modes are formed, and the degenerate modes are non-orthogonal in relation to each other, providing tuning means for tuning resonant frequencies of the degenerate modes, and controlling coupling angles and tuning means in such a way that for a number of input signals, only one input signal can be transmitted to output means, wherein the coupling means comprises angles between the input ports and a symmetry axis, which angles are nonperpendicularly azimuth.

27. Method according to claim 26, wherein the tuning is electrical.

* * * * *